US008770611B2

(12) United States Patent
Richter

(10) Patent No.: US 8,770,611 B2
(45) Date of Patent: Jul. 8, 2014

(54) ADJUSTABLE WHEELCHAIR HANDRIM WITH MOVABLE FRICTION BAND

(76) Inventor: W Mark Richter, Antioch, TN (US)

( * ) Notice: Subject to any disclaimer, the term of this patent is extended or adjusted under 35 U.S.C. 154(b) by 0 days.

(21) Appl. No.: 13/409,400

(22) Filed: Mar. 1, 2012

(65) Prior Publication Data

US 2012/0297923 A1 Nov. 29, 2012

Related U.S. Application Data

(60) Provisional application No. 61/447,989, filed on Mar. 1, 2011.

(51) Int. Cl.
*A61G 5/10* (2006.01)

(52) U.S. Cl.
CPC ..... *A61G 5/10* (2013.01)
USPC ..... 280/304.1

(58) Field of Classification Search
USPC ..... 280/250.1, 304.1; 74/558, 557, 552
See application file for complete search history.

(56) References Cited

U.S. PATENT DOCUMENTS

| | | | | |
|---|---|---|---|---|
| 4,366,964 | A * | 1/1983 | Farey et al. | 280/250.1 |
| 4,687,218 | A * | 8/1987 | Okamoto | 280/250.1 |
| 6,120,047 | A * | 9/2000 | Axelson et al. | 280/250.1 |
| 6,241,268 | B1 * | 6/2001 | Niklasson | 280/250.1 |
| 6,276,705 | B1 * | 8/2001 | Baldwin et al. | 280/250.1 |
| 7,204,503 | B2 * | 4/2007 | Goding et al. | 280/304.1 |
| 7,303,203 | B1 * | 12/2007 | Richter et al. | 280/250.1 |
| 2001/0007389 | A1 * | 7/2001 | Frauwirth | 280/304.1 |
| 2005/0077700 | A1 * | 4/2005 | Smith et al. | 280/304.1 |

* cited by examiner

*Primary Examiner* — Tony Winner
(74) *Attorney, Agent, or Firm* — Wayne Edward Ramage; Baker Donelson

(57) ABSTRACT

An adjustable manual wheelchair handrim with a moveable elastomeric friction band. The position of the tubular handrim can be moved to a desired location relative to the wheel rim depending on the needs and limits of the user. The movable friction band is stretched around the drive surface of the handrim at a desired location preventing it from moving and providing increased frictional properties when gripped by the user during pushes. The friction band can be permanently affixed at a location to further prevent movement and slippage between the handrim and the friction band.

13 Claims, 4 Drawing Sheets

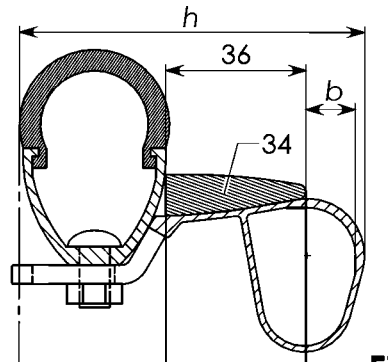
Figure 3-A
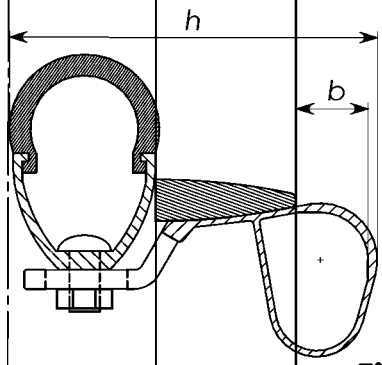
Figure 3-B
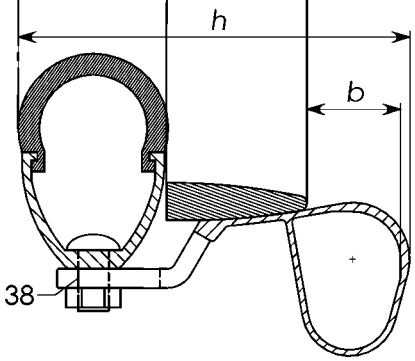
Figure 3-C

ADJUSTABLE WHEELCHAIR HANDRIM WITH MOVABLE FRICTION BAND

This application claims benefit of and priority to U.S. Provisional Application No. 61/447,989, filed Mar. 1, 2011, by W. Mark Richter, and is entitled to that filing date for priority. The specification, figures and complete disclosure of U.S. Provisional Application No. 61/447,989 are incorporated herein by specific reference for all purposes.

FIELD OF INVENTION

This invention relates generally to wheelchair handrims and, in particular, to an adjustable wheelchair handrim with a moveable friction band.

BACKGROUND OF THE INVENTION

Manual wheelchair users control and propel their wheelchairs with the handrims, also commonly called pushrims, handrings, and handrails. Handrims enable the user to propel forward, turn and brake. Unfortunately, there is a high occurrence of upper extremity injuries as a result of the repetitive stresses experienced by the user when gripping and pushing their handrims.

When propelling forward, the typical wheelchair user reaches back, grips both handrims and pushes forward until their arms are almost fully extended. The user then releases the handrim and prepares for the next push if needed. Another technique sometimes used when starting from rest or climbing a steep incline is to grab both the wheel and handrim to push. Positioning the palm of the hand on the tire and wrapping the fingers around the handrim, this provides addition torque and gripping surface area than just gripping the handrim.

Breaking is done by lightly gripping the handrim as it rotates and slides through the user's hands, decelerating the rotation of the wheels. The greater the gripping force, the higher amount of friction between the hands and handrims, and ultimately the greater the deceleration. Since wheelchair users rely on their upper extremities in this manner, pain and injuries to their arms and shoulders can significantly affect their mobility, and consequently, their independence and quality of life.

The typical handrim used by the manual wheelchair population is substantially equivalent to U.S. Pat. No. 4,687,218 (issued to Okamoto on Aug. 18, 1987), which is incorporated herein in its entirety by specific reference for all purposes. This design presents a hand rim that uses rigid standoffs spanning between the wheel rim and the handrim. Machine screws fasten the handrim to the wheel rim. Another known prior art is to attach the handrim to the wheel rim by welding rigid mounting flange members to the wheel rim and handrim.

Although effective, there are some drawbacks and inconveniences that are inherent with these designs. One drawback is that these handrims have a limited gripping surface for the user's hand to engage during pushing and breaking. An increase in contact area would cause an increase in propulsion efficiency.

Another drawback is that the offset between the handrim and the wheel is not adjustable, providing a standard spanning distance for all users regardless of their hand size and gripping limitations. This makes it impossible for users with smaller hands to use the previously discussed technique of grabbing both the wheel and handrim for climbing hills or starting from rest. In addition, quad users are sometimes not provided with sufficient space to push down on the handrim because of its proximity to the wheel.

It is also known that the user's fingers can get caught in the area between the wheel and handrim or jammed by the rigid standoffs as the wheel rotates.

Another characteristic of typical handrims is that most are generally made of a smooth metal with poor frictional properties. This results in the users needing to grip on the rim with considerable force in order to prevent slippage. Some designs have used friction coatings or materials, such as vinyl or foam, to reduce slipping and minimize the needed gripping force. While these designs are effective in improving the frictional propertied of the handrim, the coating tends to burn the hand of the user during braking.

As an alternative, other handrim designs have placed high friction materials in selected locations, which provide smooth surfaces for the user to grip during braking. While these designs are better than the typical handrim, one problem they possess is that the location of the high friction is permanent. Depending on the condition of the user and their grip limitations, the proximity of the high friction with respect to the wheel rim and tire, and with respect to the handrim contour itself, should be individualized to maximize its benefits.

This leads to the need for a wheelchair manual handrim that allows users to have the ability to move the handrim and high friction material to locations that they desire. The ability to adjust these allows users to reduce the amount of gripping force needed to push, thus relieving existing pain and reducing the potential of developing repetitive stress injuries.

SUMMARY OF INVENTION

In various exemplary embodiments, the present invention comprises an improved wheelchair handrim assembly that employs an adjustable offset and movable elastomeric friction band to improve the effectiveness and efficiency of the user's pushes by reducing slippage and the needed gripping force between the user's hand and the handrim. In one embodiment, the handrim assembly consists of an ergonomically shaped, tubular handrim with a continuous drive surface. The surface spans the gap between the tubular handrim and the wheel rim, mounting to the wheel rim with numerous rigid tabs that extrude from drive surface. Screw fasteners pass through elongated circle shaped slots in the rigid tabs and attach the handrim to the inner surface of the wheel rim.

The ergonomic handrim profile allows for maximum surface area for the user's fingers to contact, reducing the required gripping force during propulsion. The drive surface presents addition surface area from the user's palm and thumb to engage when pushing. The combination of the drive surface and ergonomic handrim provides maximum gripping surface. Additionally, the continuous drive surface protects the fingers of the users from getting caught between the handrim and wheel rim, as well as blocks them from jamming into the rigid tabs or wheel spokes.

The elongated circles slotted in the rigid tabs allow for variable offset distance between the wheel rim and the ergonomic handrim. The adjustable offset distance allows for users to position the handrim at the ideal distance from the tire depending on their hand size and grip limitations. This means a user with small hands can move the handrim as close to the wheel as possible, allowing them to grab the tire and handrim for starts and climbs. Quads are also able to move the handrim as far from the tire as allowed to reduce the obstruction of the wheel during pushes. The aforementioned embodiment is a fully functional, adjustable, ergonomic handrim with no improved frictional properties.

In one embodiment, a high friction, soft elastomeric band is stretched around the top of the drive surface. This band is held in place by the elasticity of the material from which it is made being stretched to a greater radius than its undeformed dimension. The friction between the bottom surface of the band and the top surface of the rigid standoff prevents circumferential movement when the user grips and applies a torque to the handrim during pushes. The location of the high friction band is not permanent, therefore making the distance between the band and the wheel rim and its position on the handrim assembly adjustable. This allows each individual wheelchair user to provide increased friction properties to their handrims in a desired location that will most benefit their tendencies and disabilities and a braking area that they feel it is best suited.

In another embodiment, the cross sectional shape of the high friction band can be adjusted to provide a greater area of increased friction. Also, the elastomeric band can be permanently affixed with glue or similar securing means to the handrim assembly in the desired location to prevent further movement of the band.

Ultimately, the combination of adjustable offset distance and variable shape, size, and position of the movable high friction band allows for a customizable handrim configuration for each individual manual wheelchair user. This customization will increase propulsion efficiency while reducing strain on the upper extremities of the user.

BRIEF DESCRIPTION OF THE DRAWINGS

FIG. 3 shows a cross-sectional view of the handrim adjusted to three different positions, displaying its range of adjustability relative to the wheel.

DETAILED DESCRIPTION OF EXEMPLARY EMBODIMENTS

Figure 1:
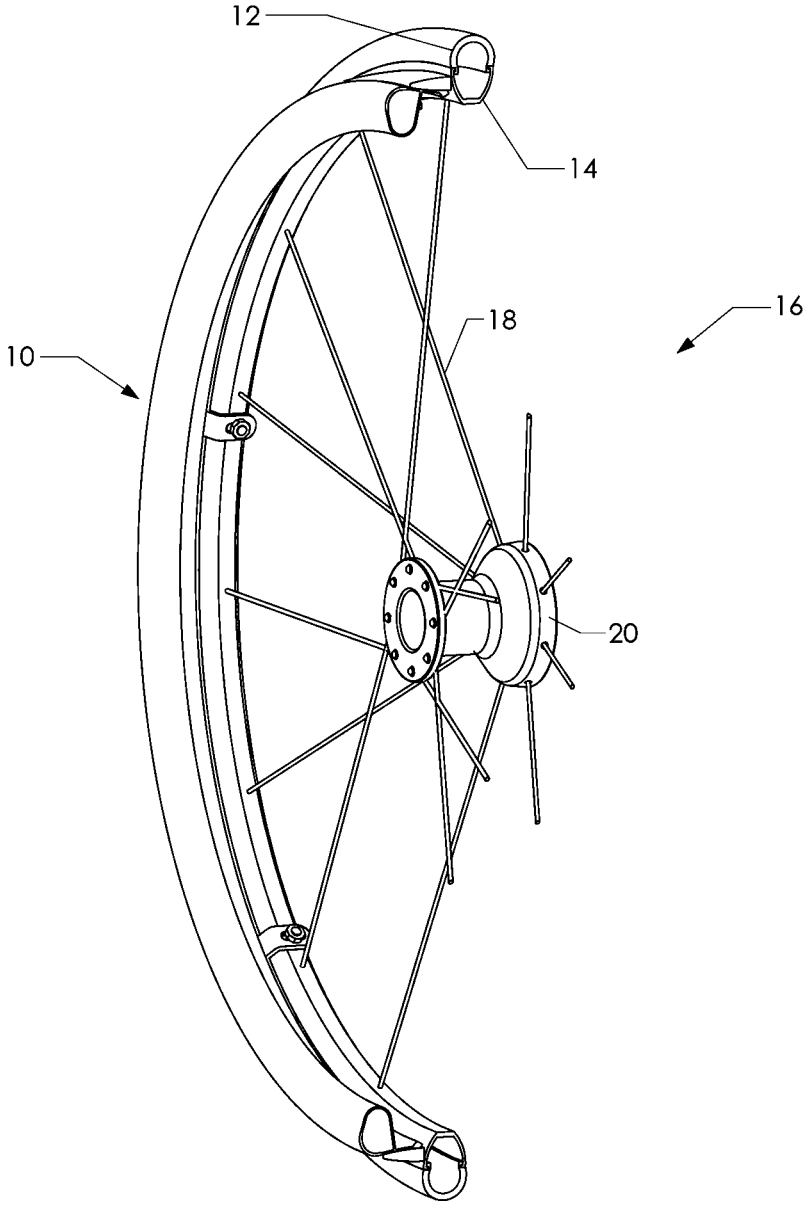
FIG. 1 shows a perspective sectional view of an adjustable wheelchair handrim with a movable friction band attached to a typical wheelchair wheel in accordance with an exemplary embodiment of the present invention.

In one exemplary embodiment, as shown in FIG. 1, the present invention comprises an adjustable wheelchair handrim with movable friction band 10 that a wheelchair user can use to propel their manual wheelchair. The adjustable wheelchair handrim with movable friction band 10 mounts to a standard wheelchair wheel rim 14 that is subsequently connected to the tire 12. The assembly of the aforementioned parts, with additional spokes 18 and a wheel hub 20, comprise a typical manual wheelchair wheel 16, where the user can grip and apply a torque to the handrim causing rotation of the wheel assembly.

Figure 2:
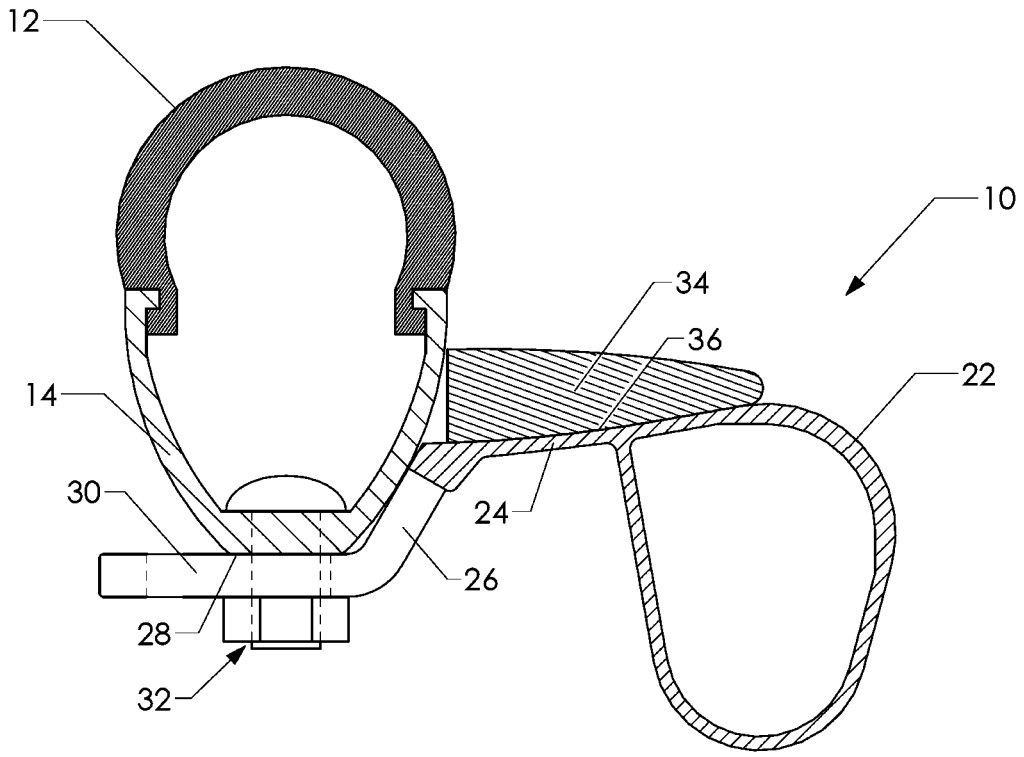
FIG. 2 shows a cross-sectional view of the wheel rim, the tire, and the adjustable wheelchair handrim with a movable friction band positioned as close to the wheel as possible.

The adjustable wheelchair handrim with movable friction band 10 is comprised of an ergonomic tubular handrim 22 which transforms directly into a drive surface 24, as can be seen in FIG. 2. The ergonomic tubular handrim 22 contains a profile that matches the shape of the hand and is sized to this manner. The drive surface 24 continuously extends from the top surface of the ergonomic tubular handrim 22, spanning the offset from the ergonomic tubular handrim 22 and the wheel rim 14. This presents an addition surface for the thumb and palm of the user to contact when gripping, while providing protection for the fingers from jamming into the spokes 18 or rigid attachment tabs 26 as the wheel rotates. The combination of the ergonomic tubular handrim 22 and the drive surface 24 provide maximum surface area for the hand of the user to grip when grabbing the handrim and performing a push.

A plurality of the aforementioned rigid attachment tabs 26 extrude or extend from the terminal end of the drive surface 24. Individual rigid attachment tabs 26 angle inward before bending horizontal, providing a level top surface 28 to mate with the inner-flat surface of the wheel rim 14. The tabs have elongated circle slots 30 through which fasteners 32 can be used to affix the handrim to the wheel rim 14. The handrim, comprising the ergonomic tubular handrim 22, drive surface 24, and rigid attachment tabs 26, is made of a metal material for durability and rigidity.

As shown in FIG. 1 and FIG. 2, an elastomeric friction band 34 stretches around the handrim and rests on the drive surface 24 and ergonomic tubular handrim 22. The aforementioned elastomeric friction band 34 possesses increased frictional properties as compared to the metal handrim. This reduces the amount of gripping needed by the user during a push and decreasing slipping between the hand and handrim. The combination of reduced gripping and slippage increases the efficiency of the user during propulsion. The user is also able to use the ergonomic tubular handrim 22 and bottom of drive surface 24 for breaking without burning or causing damage to the hand.

The elastomeric friction band 34 is held in place when the user is not gripping the handrim by the elastic properties of the band material, and the tendency of the band to contract to its undeformed dimension when stretched. The band resists circumferential movement relative to the handrim during a push through the friction between the bottom surface of the band 36 and the top surfaces of the drive surface 24 and ergonomic tubular handrim 22. The downward force of the user's hand also contributes to prevent movement.

Furthermore, the elongated circle slots 30 allow adjustability of the position of the ergonomic tubular handrim 22 relative to the wheel rim 14 and tire 12. As seen in FIG. 3, this gives the distance h needed to grip the tire and handrim a range. The offset distance can be minimized by moving the handrim inward until the drive surface 24 or rigid attachment tabs 26 contact the wheel rim 14. The offset distance can be maximized by moving the handrim outward until the outermost surface of the attachment tab slot 38 makes contact with the fastener 32. This range of adjustability presents a variable distance between the ergonomic tubular handrim 22 and the wheel rim 14 and tire 12 in addition to a variable amount of handrim surface area not in contact with the elastomeric friction band b to be used for breaking.

In another embodiment, because the elastomeric friction band 34 is held in place by its elastic deformation and is not permanently affixed to the handrim, it can be moved outward perpendicular to the plane of the wheel. When moved, more of the band rests on the ergonomic tubular handrim 22 in order to provide higher friction in a different location on the handrim. The movability of the elastomeric friction band 34 allows individual users to position the increased frictional properties in the location that is most advantageous. This movability, coupled with the adjustable offset distance, provides the user with flexibility and allows them to customize their handrim to maximize their propulsion efficiency.

Further, due to the mobility of the elastomeric friction band 34, it can be removed from the handrim. In this exemplary embodiment, the user is presented with a metal handrim with an adjustable offset distance between the ergonomic tubular handrim 22 and the wheel. Even without any added frictional properties, this embodiment still improves efficiency by providing greater contact surface area for gripping.

Figure 4:
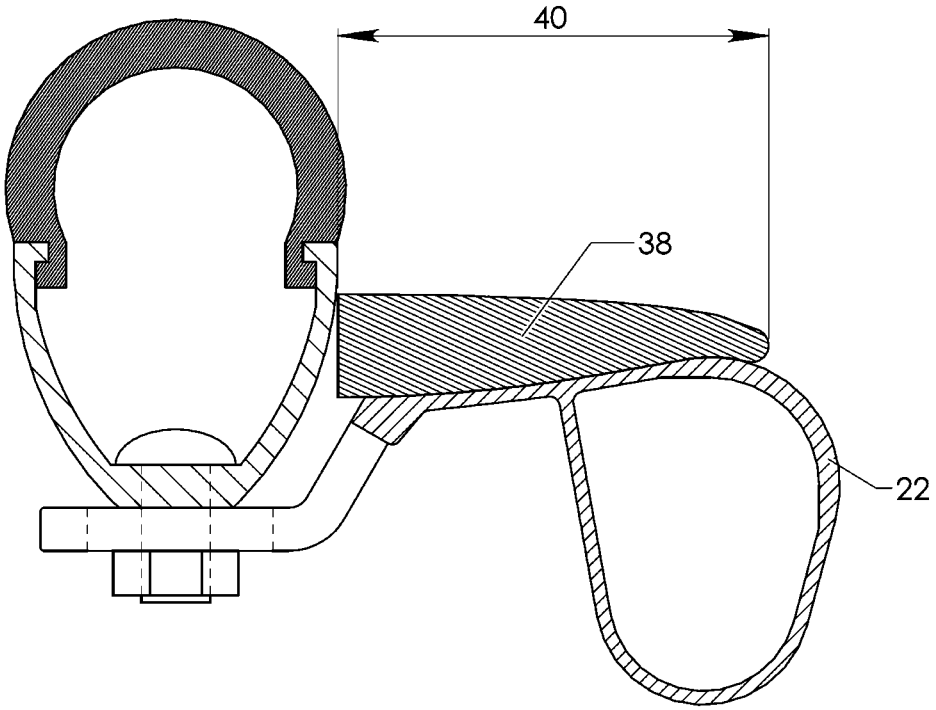
FIG. 4 shows a cross-sectional view of a larger elastomeric friction band with a greater depth.

In other embodiments, the position of the handrim relative to the wheel rim 14 and tire 12 can be adjusted to any desired location, thus varying the offset distance. In yet other embodiments, the position of the elastomeric friction band relative to the wheel rim 14 and handrim can be adjusted to any desired location. FIG. 4 illustrates an embodiment where a large elastomeric friction band 38 with a greater depth 40 than the depth 36 of the elastomeric friction band 34 shown in FIG. 3 is used to provide more surface area of increased friction. This kind of band is advantageous to a user with limited gripping ability and that mostly relies on applying a downward force to the top surface of the handrim in order to induce rotation of the wheel.

The contour of the elastomeric band can be changed in order to provide the best configuration for each individual wheelchair user. Also, the position of the band, regardless of its profile, can be permanently affixed to the handrim if the configuration is found to be ideal and permanence of band location is advantageous. The method of mounting can be by chemical adhesives, rigid fasteners, or any other means.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

What is claimed is:

1. A handrim for a wheel of a manual wheelchair, comprising:

a tubular handrim;

an attachment mount for affixing the handrim to a wheel rim of said wheel, wherein the attachment mount is slidingly attached to the wheel rim to move the handrim to a plurality of offset distances from the wheel rim; and a movable elastomeric friction band positioned between the handrim and the wheel rim.

2. The handrim of claim 1, wherein the handrim comprises an ergonomic tubular shape that profiles the hand when gripped.

3. The handrim of claim 1, further comprising a drive surface that wholly or partially spans a gap between the handrim and the wheel rim.

4. The handrim of claim 3, wherein the drive surface extends around the periphery of the handrim.

5. The handrim of claim 1, wherein said attachment mount comprises a plurality of rigid attachment tabs that extrude from a terminating end of the drive surface.

6. The handrim of claim 5, said rigid attachment tabs comprising elliptical or circular slots, adapted to receive fasteners to mount the handrim to the wheel rim.

7. The handrim of claim 6, where the offset distance of the handrim from the wheel rim is adjusted by securing the fasteners at different positions in the slots.

8. The handrim of claim 1, wherein the friction band is permanently affixed to the handrim.

9. The handrim of claim 1, wherein the friction band is stretched over the handrim and only held in place by the elasticity of the band.

10. A handrim for a wheel of a manual wheelchair, comprising:

a handrim affixed to a wheel rim of said wheel, wherein the handrim has an ergonomic tubular shape that profiles the hand when gripped;

a drive surface that extends from a top of the tubular handrim and wholly or partially spans a gap between the handrim and the wheel rim;

an elastomeric friction band positioned between the handrim and the wheel rim; and a plurality of attachment tabs extruding from one end of the drive surface, said attachment tabs comprising slots adapted to receive fasteners to mount the handrim to the wheel rim;

wherein the offset distance of the handrim from the wheel rim is adjustable by moving the position of the attachment tabs laterally relative to the wheel rim.

11. An adjustable handrim for a wheel of a manual wheelchair, comprising:

a tubular handrim with a top;

a drive surface that extends from the top of the tubular handrim and wholly or partially spans a gap between the handrim and the wheel rim of a wheelchair wheel when mounted; and a plurality of attachment tabs that extrude from one end of the drive surface, wherein the attachment tabs have slots adapted to receive fasteners to mount the handrim to the wheel rim, wherein the offset distance of the handrim from the wheel rim is adjustable by moving the position of the attachment tabs laterally relative to the wheel rim.

12. The handrim of claim 11, wherein the handrim comprises an ergonomic tubular shape that profiles the hand when gripped.

13. The handrim of claim 11, further comprising an elastomeric friction band stretched over the handrim and drive surface.

* * * * *